US012747662B2

(12) United States Patent
Larbi Zeghlache

(10) Patent No.: US 12,747,662 B2
(45) Date of Patent: Sep. 29, 2026

(54) SYSTEM AND METHOD FOR UNTETHERED MULTIFINGER IMAGING OF A WELLBORE INNER WALL

(71) Applicant: SAUDI ARABIAN OIL COMPANY, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 379 days.

(21) Appl. No.: 18/591,769

(22) Filed: Feb. 29, 2024

(65) Prior Publication Data

US 2024/0401464 A1 Dec. 5, 2024

Related U.S. Application Data

(60) Provisional application No. 63/505,000, filed on May 30, 2023.

(51) Int. Cl.
*E21B 47/002* (2012.01)
*E21B 47/08* (2012.01)

(52) U.S. Cl.
CPC ..... *E21B 47/0025* (2020.05); *E21B 47/08* (2013.01)

(58) Field of Classification Search
CPC ..... E21B 47/0025; E21B 47/08
See application file for complete search history.

(56) References Cited

U.S. PATENT DOCUMENTS

| | | | | |
|---|---|---|---|---|
| 11,466,526 | B1 * | 10/2022 | Musso | E21B 23/00 |
| 11,572,751 | B2 * | 2/2023 | Musso | E21B 47/13 |
| 11,767,729 | B2 * | 9/2023 | Musso | E21B 33/12 166/250.01 |
| 2022/0010630 | A1 * | 1/2022 | Musso | E21B 47/138 |
| 2022/0010648 | A1 * | 1/2022 | Musso | E21B 47/138 |
| 2023/0176015 | A1 * | 6/2023 | Fadhel | G01C 19/5712 73/579 |
| 2024/0401464 | A1 * | 12/2024 | Larbi Zeghlache | E21B 47/08 |

FOREIGN PATENT DOCUMENTS

| | | | | |
|---|---|---|---|---|
| WO | WO-2022011387 | A1 * | 1/2022 | E21B 47/138 |
| WO | WO-2022011388 | A1 * | 1/2022 | E21B 47/017 |

* cited by examiner

*Primary Examiner* — Daniel Pihulic
(74) *Attorney, Agent, or Firm* — Osha Bergman Watanabe & Burton LLP

(57) ABSTRACT

An untethered caliper tool for measuring a diameter of a conduit having a wall and a fluid, the untethered caliper tool includes one or more fingers connected to a body and configured to extend or retract about an axis of the body. A control system is located within the body, having automation capabilities, configured to track movement of the one or more fingers caused by the wall of the conduit, and configured to determine the diameter of the conduit based on the movement of the one or more fingers. A buoyancy device is connected to the body. A weight is detachably connected to the body. The weight is configured to allow the body to descend through the fluid in the conduit and the buoyancy device is configured to allow the body to ascend through the fluid in the conduit when the weight is removed from the body.

20 Claims, 10 Drawing Sheets

SYSTEM AND METHOD FOR UNTETHERED MULTIFINGER IMAGING OF A WELLBORE INNER WALL

BACKGROUND

Hydrocarbons are located in porous rock formations beneath the Earth's surface. Wells are drilled into these formations to produce the hydrocarbons. Wells are formed by drilling a wellbore from the surface into the formation. Casing strings are cemented into the wellbore to provide structural support for the well. The wellbore is often drilled in sections, each section having a different diameter. Each section may then be cased using a casing string.

The theoretical diameter of each wellbore section is based on the diameter of the drill bit used to drill the wellbore section. The theoretical diameter of each casing string is based on the manufacturer specification of the casing string run into the wellbore. However, the actual diameter of the wellbore may differ from the diameter of the drill bit due to washout of the wellbore wall, ledges of the wellbore wall, etc. Furthermore, the inner diameter of the casing strings cemented in the wellbore may also differ from the manufacturer specification due to scale, corrosion, damage, debris, collars, differing joint or tool sizes, etc. In order to perform subsequent well operations, it is important to know the actual diameter of the wellbore and/or the casing string across the length of the well.

SUMMARY

In general, in one or more embodiments, the invention relates to an untethered caliper tool for measuring a diameter of a conduit having a wall and a fluid, the untethered caliper tool comprising: one or more fingers connected to a body and configured to extend or retract about an axis of the body; a control system located within the body, having automation capabilities, configured to track movement of the one or more fingers caused by the wall of the conduit, and configured to determine the diameter of the conduit based on the movement of the one or more fingers; a buoyancy device connected to the body; and a weight detachably connected to the body, wherein the weight is configured to allow the body to descend through the fluid in the conduit and the buoyancy device is configured to allow the body to ascend through the fluid in the conduit when the weight is removed from the body.

In general, in one or more embodiments, the invention relates to a method for measuring a diameter of a conduit having a wall and a fluid, the method comprising: deploying an untethered caliper tool into the conduit; descending the untethered caliper tool through the fluid of the conduit using a weight detachably connected to a body of the untethered caliper tool; detaching the weight from the body of the untethered caliper tool to ascend the untethered caliper tool through the fluid of the conduit using a buoyancy device connected to the body of the untethered caliper tool; retracting one or more fingers towards an axis of the body of the untethered caliper tool using a control system; extending the one or more fingers away from the axis of the body of the untethered caliper tool using the control system to touch the one or more fingers against the wall of the conduit; and determining the diameter of the conduit by tracking movement of the one or more fingers caused by the wall of the conduit using the control system.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein propose a solution to automate downhole inner wall imaging using untethered system. Multifinger calipers are a very common tool used for downhole and surface imaging of the inner wall of tubing/casing, borehole, pipelines, etc. For downhole applications, they are used in cased hole for corrosion and scale evaluation and open hole for borehole profile and volume. This mechanical tool uses fingers that extend to read the inner radius. Based on the nominal ID of the tubing or casing in the completion, corrosion and scale are calculated.

Figure 1:
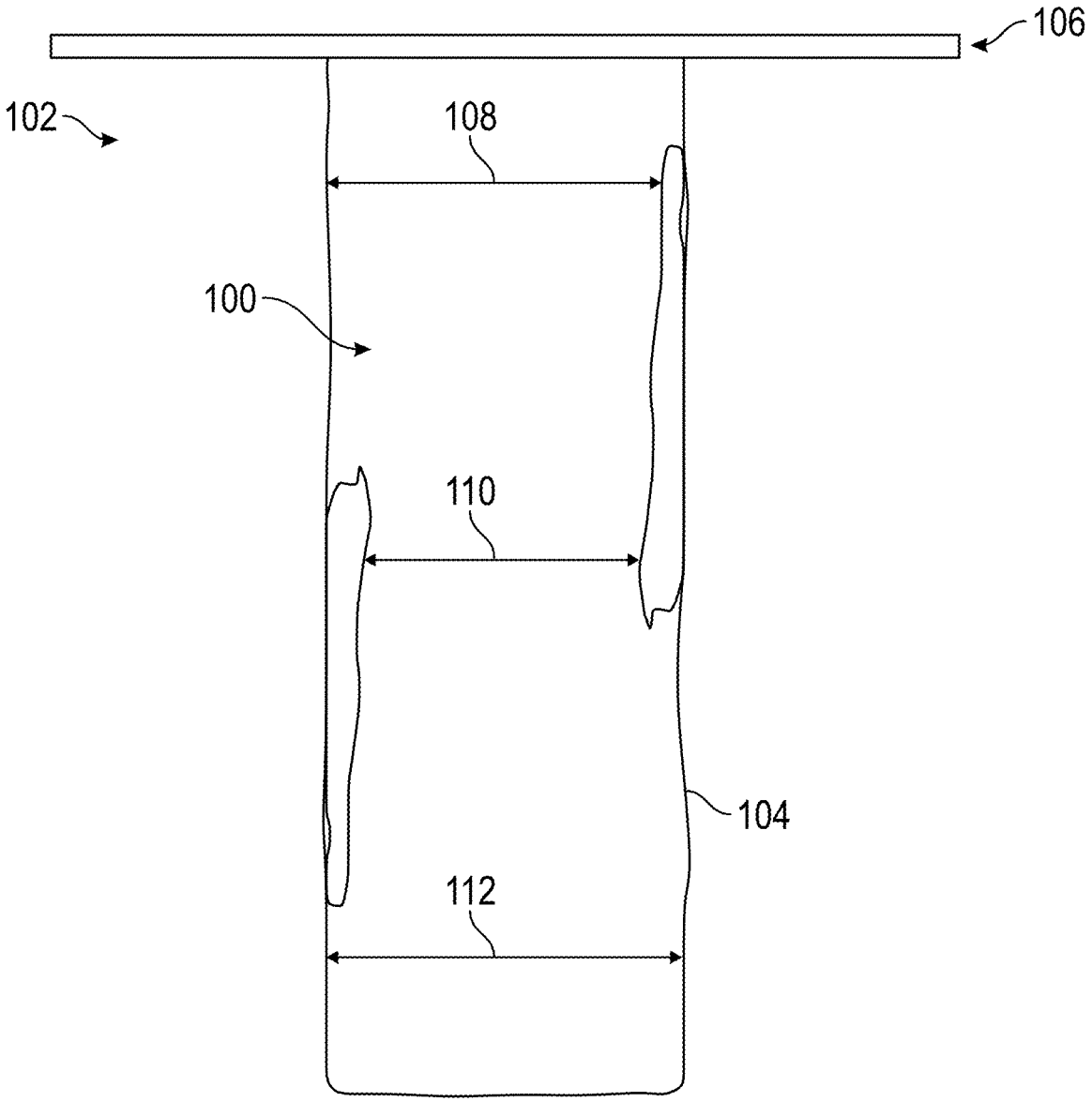
FIG. 1 shows a conduit extending through a subsurface location in accordance with one or more embodiments.

FIG. 1 shows a conduit (100) extending through a subsurface location (102) in accordance with one or more embodiments. The conduit (100) is defined by a wall (104) that is located in the subsurface location (102). The conduit (100) may extend from a surface location (106) into the subsurface location (102). The surface location (106) may be any location on or above the Earth's surface.

In accordance with one or more embodiments, the conduit (100) is part of a well drilled into the subsurface location (102). The well may be used to access and produce hydrocarbons from a formation located in the subsurface location (102). The wall (104) may be a wellbore wall or an inner surface of a tubular, such as a casing string, without departing from the scope of the disclosure herein. In further embodiments, the conduit (100) is filled with a fluid, such as drilling mud, completions fluid, brine, etc. A well may use the fluid to control bottom hole pressures, perform various well operations, or provide well control.

In accordance with one or more embodiments, the conduit (100) has differing diameters. In particular, FIG. 1 shows the conduit having three different diameters: D1 (108), D2 (110), and D3 (112). The conduit (100) may have varying diameters due to a multitude of scenarios. For example, if the conduit (100) is the conduit (100) of a wellbore drilled into the subsurface location (102), the diameter of the conduit (100) may vary due to washout of the wellbore wall, ledges of the wellbore wall, etc. If the conduit (100) is the conduit (100) of a tubular, such as a casing string, located within the wellbore, the diameter of the conduit (100) may vary due to scale, corrosion, damage, debris, collars, differing joint or tool sizes, etc.

In order to perform subsequent well operations, it is important to know the actual diameter of the wellbore and/or the casing string across the length of the well. It is also important to be able to map the wall (104) profile. Conventionally, a caliper tool may be run into the conduit (100) to measure the diameter and wall (104) profile of the conduit (100). Conventional caliper tools require a deployment mechanism such as coiled tubing, slickline, or wireline to operate the caliper tool and gather the data obtained from the caliper tool. Coiled tubing, slickline, and wireline operations require separate units to be deployed to the well.

The present disclosure outlines an untethered caliper tool that can be deployed in a conduit without the need of a separate unit. This allows the caliper tool to be used on a smaller scale requiring less personnel and equipment. Requiring less personnel and equipment allows the operation to be performed more efficiently. An efficient operation saves resources and allows for less time to be spent on a well thus decreasing opportunity for well control incidents which may harm people and the environment.

Figure 2C:
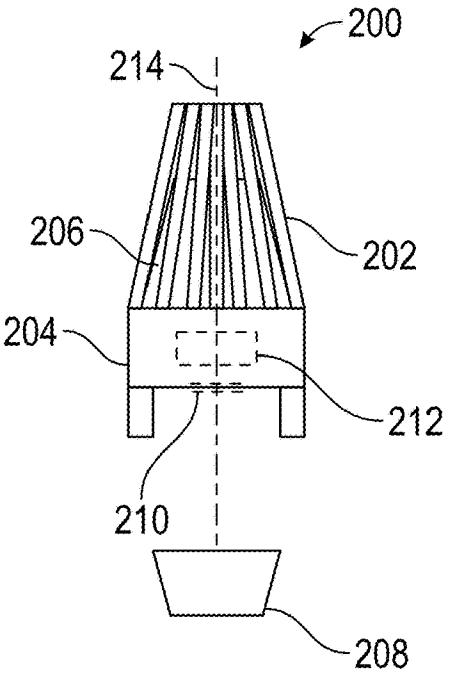
FIGS. 2*a*-2*c* show a side view of a log-down untethered caliper tool in accordance with one or more embodiments.
Figure 2B:
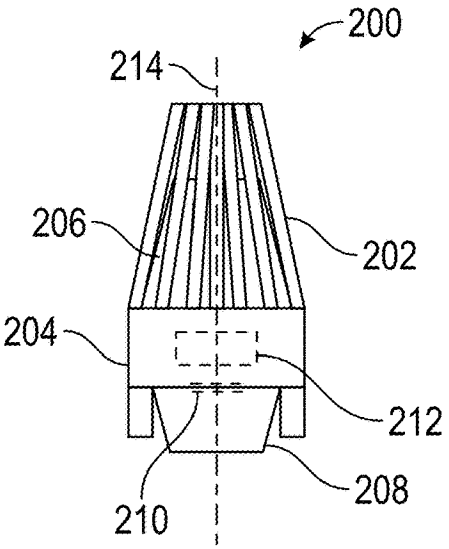
Figure 2A:
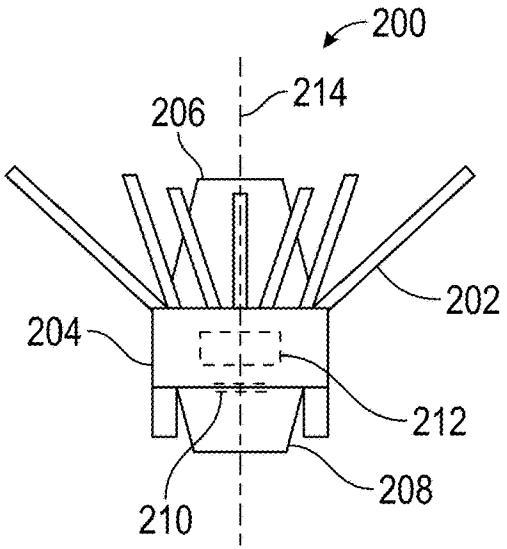

FIGS. 2*a*-2*c* show a side view of a log-down untethered caliper tool (200) in accordance with one or more embodiments. FIG. 2*a* shows the log-down untethered caliper tool (200) in an extended and sinkable position. FIG. 2*b* shows the log-down untethered caliper tool (200) in a retracted and sinkable position. FIG. 2*c* shows the log-down untethered caliper tool (200) in a retracted and buoyant position.

In accordance with one or more embodiments, the log-down untethered caliper tool (200) is used to measure the diameter and profile of the wall (104) as the log-down untethered caliper tool (200) descends through the conduit (100), i.e., when the log-down untethered caliper tool (200) is in the extended and sinkable position as shown in FIG. 2*a*.

Specifically, the log-down untethered caliper tool (200) may measure the internal radius of the conduit (100). All individual radii measurements are transmitted to the surface location (106) or recorded in the memory of the log-down untethered caliper tool (200). Inclination and log-down untethered caliper tool (200) relative bearing measurements may also be recorded, the latter facilitating the orientation of any features with respect to high/low side of the conduit (100). The deployment operation of the log-down untethered caliper tool (200) is further outlined below in FIGS. 6*a*-6*e*.

The log-down untethered caliper tool (200) includes one or more fingers (202), a body (204) a buoyancy device (206), and a weight (208). An electromagnet (210) is located between the body (204) and the weight (208) of the log-down untethered caliper tool (200). A control system (212) is located inside of the body (204) of the log-down untethered caliper tool (200). The control system (212) gathers and stores data from the log-down untethered caliper tool (200), controls the position of the fingers (202), and controls operation of the electromagnet (210). The control system (212) is outlined in detail below in FIG. 5.

The fingers (202) of the log-down untethered caliper tool (200) are physically connected to the body (204) and are electronically and/or physically connected to the control system (212). The fingers (202) are movably connected to the body (204) such that the fingers (202) are able to move angular positions in relation to the body (204) of the log-down untethered caliper tool (200). The fingers (202) may be movably connected to the body (204) using any means known in the art, such as hinges, springs, etc.

In accordance with one or more embodiments, the fingers (202) have an extended and a retracted position. In the extended position, the fingers (202) are pointed away from an axis (214) running through the center of the body (204) of the log-down untethered caliper tool (200). In the retracted position, the fingers (202) are pointed towards the axis (214).

For the log-down untethered caliper tool (200) in particular, the fingers (202) are connected to the body (204) and extend from the body (204) in a direction towards the buoyancy device (206). Thus, when the fingers (202) are in the retracted position, the fingers (202) retract around the buoyancy device (206).

FIG. 2*a* shows the fingers (202) in the extended position. FIGS. 2*b* and 2*c* show the fingers (202) in the retracted position. In the extended position, the fingers (202) may be able to move angular positions due to an external force acting on the fingers (202), for example, from the wall (104) of the conduit (100). In accordance with one or more embodiments, each finger (202) is moved independent from one another based on the geometry of the wall (104) of the conduit (100). This independent movement of each finger (202) allows for an accurate representation of the surface area/profile of the wall (104). As such, the fingers (202) are configured to adhere to changes int eh inner wall (104) profile with minimum effect on the stability of the device.

The control system (212) may track the movement of each finger (202) in the extended position to measure the diameter and/or wall (104) profile of the conduit (100) through which the log-down untethered caliper tool (200) is deployed within. The measurements obtained through movement of each finger (202) and any sensors in the control system (212) are stored in the memory of the control system (212) and may be retrieved at the surface location (106) using a computer.

The fingers (202) may be made out of any material known in the art. In accordance with one or more embodiments, the fingers (202) may me made of a non-metallic material in order to aid in buoyancy of the tool. The number and length of fingers (202) connected to the body (204) depends on the accuracy of measurements required and the environment in which the log-down untethered caliper tool (200) is deployed within. For example, a conduit (100) having a larger diameter may require longer fingers (202) compared to a conduit (100) having a smaller diameter. In further embodiments, the more fingers (202) present on the log-down untethered caliper tool (200), the more accurate the measurements will be because the fingers (202) can track more of the surface area of the wall (104).

In accordance with one or more embodiments, the weight (208) is connected to the body (204) using the electromagnet (210). In accordance with one or more embodiments, the control system (212) controls the operation of the electromagnet (210) in order to release the weight (208) from the body (204). That is, the control system (212) may power on the electromagnetic to create a magnetic force. The magnetic force keeps the weight (208) connected to the body (204). The control system (212) may turn off the electromagnet (210) to stop producing the magnetic force which causes the weight (208) to disconnect from the body (204).

FIGS. 2*a* and 2*b* show the log-down untethered caliper tool (200) in a sinkable position due to the weight (208) being connected to the body (204) of the log-down untethered caliper tool (200) via the electromagnet (210). FIG. 2*c* shows the log-down untethered caliper tool (200) in a buoyant position due to the weight (208) being disconnected from the body (204) of the log-down untethered caliper tool (200).

In accordance with one or more embodiments, the weight (208) is made out of a magnetic material so that the weight (208) will be magnetically attracted to the electromagnet (210) when the electromagnet (210) is creating the magnetic force. The weight (208) may also be made out of a relatively dense material in order to cause the weight (208) to have a pre-determined mass. In further embodiments, the weight (208) is made out of a dissolvable material such that extended exposure of the weight (208) to a fluid, such as the fluid in the conduit (100), causes the weight (208) to dissolve.

In accordance with one or more embodiments, the mass of the weight (208), and thus the volume and material make-up of the weight (208), depends on how much force is required to overcome the buoyancy force created by the buoyancy device (206) so that the log-down untethered caliper tool (200) is able to descend through the fluid in the conduit (100).

The buoyancy device (206) is connected to the body (204) of the log-down untethered caliper tool (200) using any type of connection known in the art such as material fusion, hooks, clips, etc. The buoyancy device (206) may be any type of device that is able to cause the log-down untethered caliper tool (200) to overcome fluid pressure and ascend through the fluid located in the conduit (100). In other words, the buoyancy device (206) is any device that can cause the overall density of the log-down untethered caliper tool (200) to be less than the density of the fluid when the weight (208) is released from log-down untethered caliper tool (200).

Thus, the design of the buoyancy device (206) depends on the mass and volume of the fluid located in the conduit (100) and the mass and volume of the log-down untethered caliper tool (200) without the weight (208). For example, the buoyancy device (206) may be made out of a low-density material and/or a gas located in a container. In further embodiments, the buoyancy device (206) and/or the weight (208) are formed in truncated cone-like shapes.

Figure 3B:
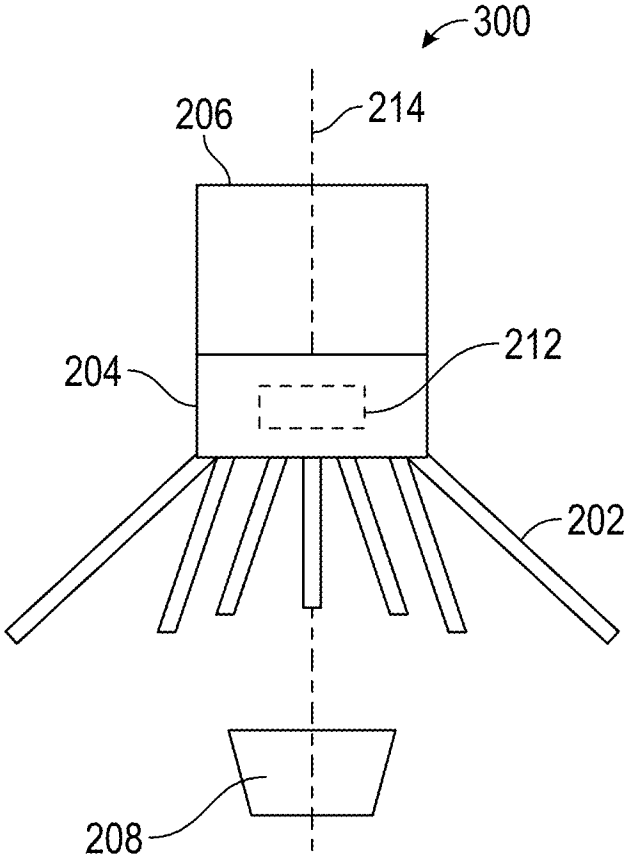
FIGS. 3*a* and 3*b* show a side view of a log-up untethered caliper tool in accordance with one or more embodiments.
Figure 3A:
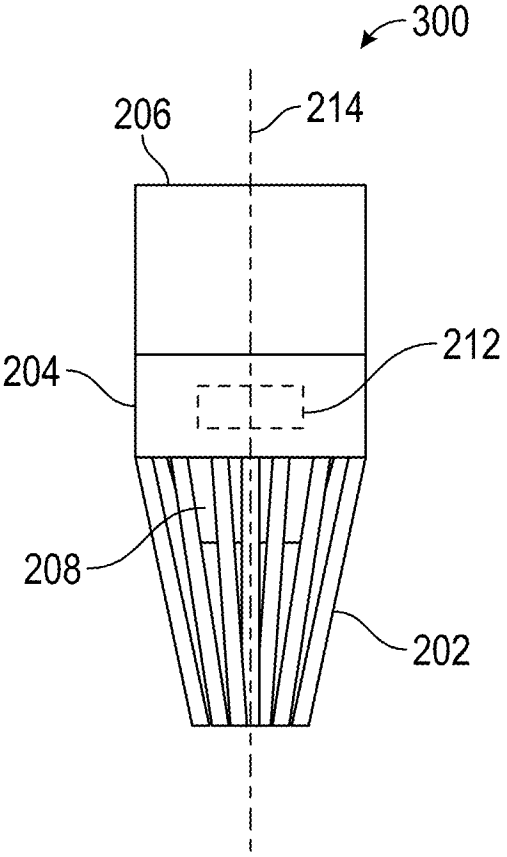

FIGS. 3*a* and 3*b* show a side view of a log-up untethered caliper tool (300) in accordance with one or more embodiments. Components shown in FIGS. 3*a* and 3*b* that are the same as or similar to components shown in FIGS. 1-2*c* have not been re-described for purposes of readability and have the same description and function as outlined above. FIG. 3*a* shows the log-up untethered caliper tool (300) in a retracted and sinkable position. FIG. 3*b* shows the log-up untethered caliper tool (300) in an extended and buoyant position.

In accordance with one or more embodiments, the log-up untethered caliper tool (300) is used to measure the diameter and profile of the wall (104) as the log-up untethered caliper tool (300) ascends through the conduit (100), i.e., when the log-up untethered caliper tool (300) is in the extended and buoyant position. The deployment operation of the log-up untethered caliper tool (300) is further outlined below in FIGS. 7*a*-7*e*.

The log-up untethered caliper tool (300) may be similar to the log-down untethered caliper tool (200) in every aspect except the log-up untethered caliper tool (300) may or may not use the electromagnet (210) to connect the weight (208) to the body (204) and the direction in which the fingers (202) extend from the body (204).

For the log-up untethered caliper tool (300) in particular, the fingers (202) are connected to the body (204) and extend from the body (204) in a direction towards the weight (208). When the fingers (202) are in the retracted position, the fingers (202) retract around the weight (208). Thus, the weight (208) may be held against the body (204) using the fingers (202) as a cradle or the weight (208) may be connected to the body (204) using the electromagnet as outlined in FIGS. 2*a*-2*c*. That is, the weight (208) may be released from the body (204) by extending the fingers (202). In other embodiments, the weight (208) may be released from the body (204) through both extension of the fingers (2020) and deactivation of the electromagnet (210) if there is not enough clearance to allow the released weight (208) to pass through the fingers (202).

In further embodiments, the log-up untethered caliper tool (300) may replace or support the buoyancy device (206) using the fingers (202). In accordance with one or more embodiments, the fingers (202) are made out of a rugged and lightweight material that, when extended, creates a partial membrane. That is, the fluid is only able to flow through a restricted area between the fingers (202). The restriction of flow may allow the log-up untethered caliper tool (300) to ascend through the fluid.

Figure 4A:
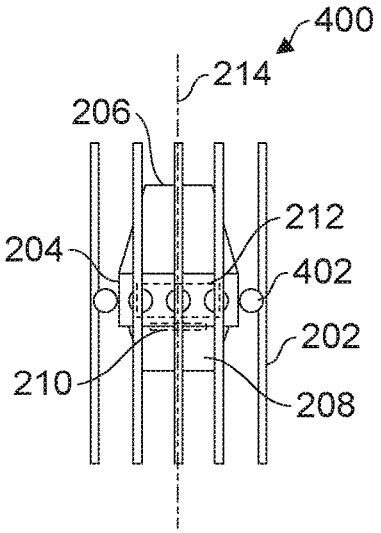
FIGS. 4*a*-4*d* show a side view of a bidirectional untethered caliper tool in accordance with one or more embodiments.
Figure 4B:
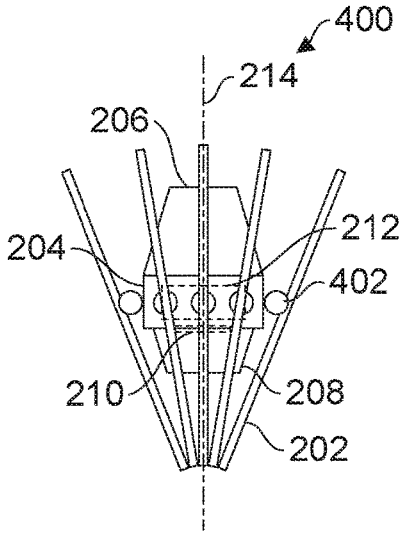
Figure 4C:
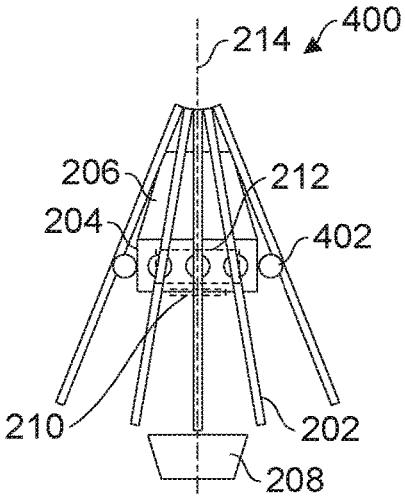
Figure 4D:
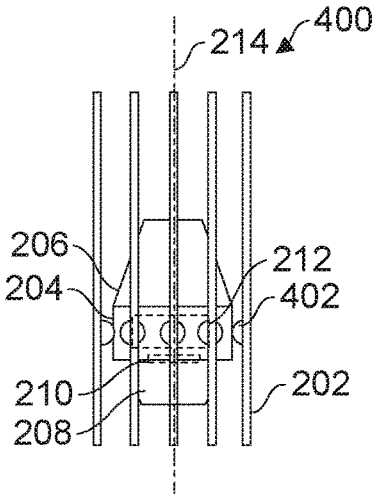

FIGS. 4*a*-4*d* show a side view of a bidirectional untethered caliper tool (400) in accordance with one or more embodiments. Components shown in FIGS. 4*a*-4*d* that are the same as or similar to components shown in FIGS. 1-3*b* have not been re-described for purposes of readability and have the same description and function as outlined above. FIG. 4*a* shows the bidirectional untethered caliper tool (400) in a neutral position. FIG. 4*b* shows the bidirectional untethered caliper tool (400) in an extended log-down and sinkable position. FIG. 4*c* shows the bidirectional untethered caliper tool (400) in an extended log-up and buoyant position. FIG. 4*d* shows the bidirectional untethered caliper tool (400) in a neutral position and configured to measure varying sizes of tubulars in a singular run.

In accordance with one or more embodiments, the bidirectional untethered caliper tool (400) is used to measure the diameter and profile of the wall (104) as the bidirectional untethered caliper tool (400) both ascends and descends through the conduit (100). This allows the diameter and wall (104) profile measurements to be more accurate than measurement obtained during unidirectional movement. The deployment operation of the bidirectional untethered caliper tool (400) is further outlined below in FIGS. 8*a*-8*e*.

The bidirectional untethered caliper tool (400) may be similar to both the log-up untethered caliper tool (300) and the log-down untethered caliper tool (200) in every aspect except the fingers (202) of the bidirectional untethered caliper tool (400) can retract around both the weight (208) and the buoyancy device. As such, the fingers (202) may be connected to the body (204) of the bidirectional untethered caliper tool (400) using a multi-directional hinge, such as a ball hinge (402). The direction in which the fingers (202) retract may be controlled by the control system (212).

When the bidirectional untethered caliper tool (400) is in the extended log-down position, the fingers retract around the weight (208) and extend outwardly around the buoyancy device (206). Thus, as the bidirectional untethered caliper tool (400) uses the weight (208) to descend in the conduit (100), the fingers (202) measure the diameter and wall (104) profile of the conduit (100).

When the bidirectional untethered caliper tool (400) is in the extended log-up position, the fingers (202) retract around the buoyancy device (206) and extend outwardly around the portion of the body (204) that was connected to the weight (208). Thus, and after the weight (208) is removed from the body (204), the bidirectional untethered caliper tool (400) may measure the diameter and wall (104) profile of the conduit (100) as the bidirectional untethered caliper tool (400) ascends through the conduit (100).

The bidirectional untethered caliper tool (400) may or may not use the electromagnet (210) to connect the weight (208) to the body (204). When the fingers (202) are in the extended log-down position, the fingers (202) retract around the weight (208). Thus, the weight (208) may be held against the body (204) using the fingers (202) as a cradle or the weight (208) may be connected to the body (204) using the electromagnet as outlined above in FIGS. 2*a*-2*c*. That is, the weight (208) may be released from the body (204) by either extending the fingers (202) from the weight (208) or by deactivating the electromagnet (210).

FIGS. 4*a*-4*c* show the ball hinges (402) at the center of the fingers (202). This allows for the fingers (202) to have the same maximum extension whether in the extended log-up or extended log-down position. FIG. 4*d* shows the ball hinges (402) not installed in the center of the fingers (202). FIG. 4*d* shows the ball hinges (402) installed on the downhole end of the fingers (202). With the ball hinges (402) located off-center of the fingers (202) in this manner, the maximum extension of the fingers (202) in the extended log-up position is smaller than the maximum extension of the fingers (202) in the extended log-down position. This allows for measurement of large and small diameters in the same run.

For example, a well may be designed using a liner installed on the downhole end of a casing string. This means the conduit (100) of the casing string is larger than the conduit (200) of the liner. This difference may be large enough that a caliper tool having only a single maximum extension size cannot measure the actual diameters and wall (104) profile of both conduits (100). Thus, the bidirectional untethered caliper tool (400) having two maximum extension sizes of the fingers (202), as shown in FIG. 4*d*, solves this issue and allows for measurement of both the smaller-diameter liner and the larger-diameter casing string in a singular run.

Figure 5:
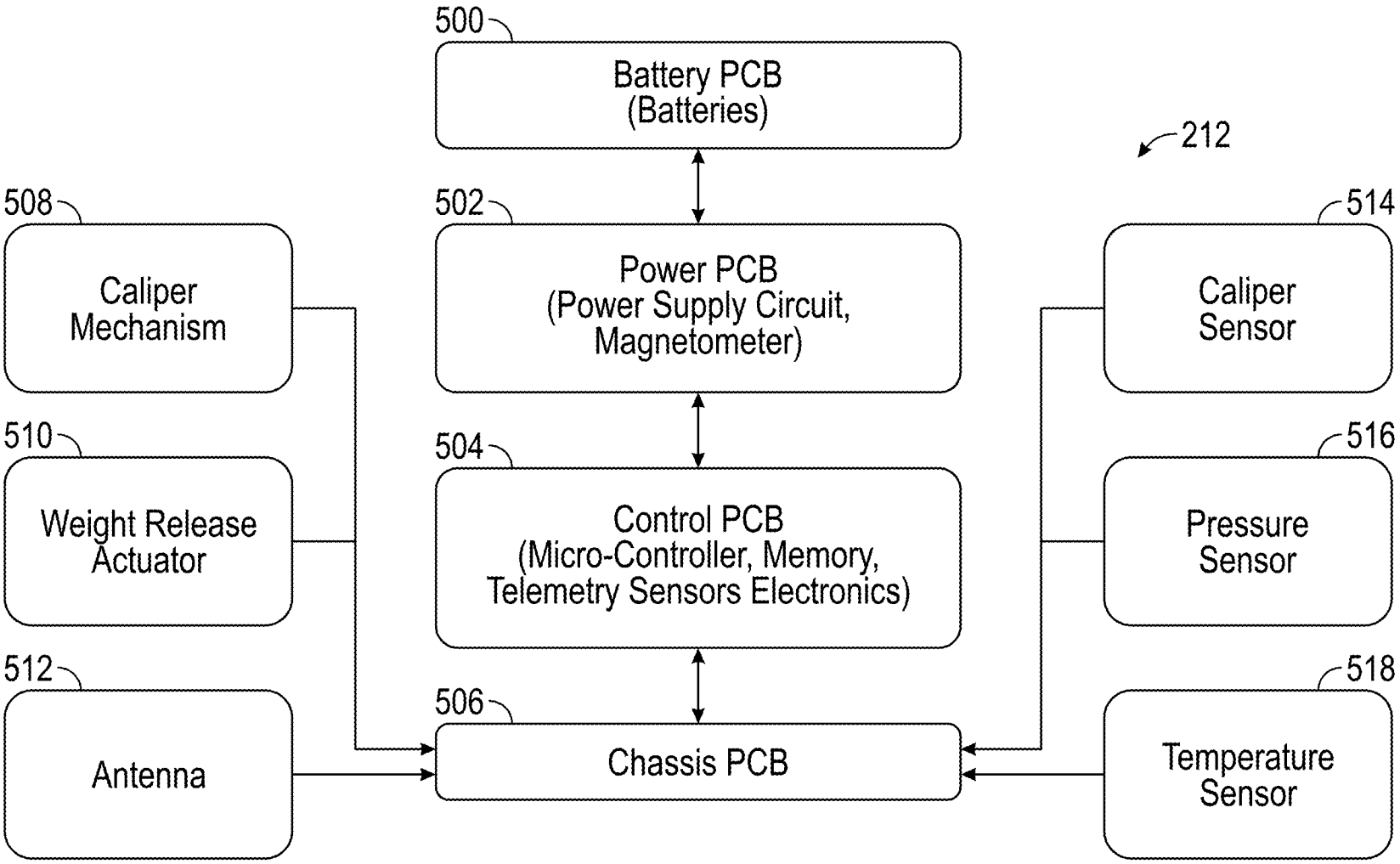
FIG. 5 shows the control system in accordance with one or more embodiments.

FIG. 5 shows the control system (212) in accordance with one or more embodiments. The control system (212) includes a battery printed circuit board (PCB) (500), a power PCB (502), a control PCB (504), and a chassis PCB (506). The battery PCB (500) may include one or more batteries that store energy. The battery PCB (500) may be electronically connected to the power PCB (502).

The power PCB (502) may include a power supply circuit and a magnetometer. In accordance with one or more embodiments, the power PCB (502) controls the distribution of energy throughout the control system (212). The control PCB (504) may include a micro-controller, a memory, and telemetry sensor electronics. The control PCB (504) sends instructions throughout the control system (212) and the untethered caliper tool (200, 300, 400).

A caliper sensor (514) may be used to sense the location and movement of the caliper mechanism (508) which may be connected to each of the fingers (202). The weight release actuator (510) may be the electromagnet (210) outlined above. The antenna (512) may be used to enable data transmission from the control system to a computer, not pictured. The control system (212) may further include a pressure sensor (516) and a temperature sensor (518). The pressure sensor (516) and the temperature sensor (518) may be used to gather pressure and temperature data.

The pressure and temperature data, along with data obtained using the telemetry sensor electronics, may be used in conjunction with a program stored on the control PCB (504) to enable automatic operation of the untethered caliper tool (200, 300, 400). This automatic operation is further outlined in FIGS. 6*a*-8*e* below.

In accordance with one or more embodiments, the chassis PCB (506) is used to provide electrical and mechanical connection between the caliper mechanism (508), the weight release actuator (510), the antenna (512), and the sensors (514, 516, 518). That is, the chassis PCB (506) may host the electronics for the power system (500, 502), the sensors (514, 516, 518), the electromagnet (510), and the antenna (512).

Prior to deployment of untethered caliper tool (200, 300, 400) into the conduit (100), the untethered caliper tool (200, 300, 400) may be assembled for the particular environment. For example, the size and number of fingers (202) may be selected by the operator based on well conditions, well surveillance, intervention objectives, etc. The body (204) size, the type and size of the buoyancy device (206), and the number and type of sensors may also be determined by the operator.

Subsequently, the operator may determine the optimal arrangement of the untethered caliper tool (200, 300, 400) (i.e., log-down, log-up, or bidirectional arrangement). Before and after deploying the untethered caliper tool (200, 300, 400) into the conduit (100), a calibration may be performed on the untethered caliper tool (200, 300, 400) by at least using a 2-point calibration. The 2-point calibration includes two concentric rings of known internal diameters. The calibration may include testing of all sensors and may require connection of the untethered caliper tool (200, 300, 400) to a computer for bidirectional communication. In other embodiments, the calibration of the untethered caliper tool (200, 300, 400) may be automated using the control system (212) and may not require connection to a computer.

FIGS. 6*a*-6*e* show an operational sequence of the log-down untethered caliper tool (200) in accordance with one or more embodiments. Components shown in FIGS. 6*a*-6*e* that are the same as or similar to components shown in FIGS. 1-5 have not be re-described for purposes of readability and have the same description and function as outlined above.

Figures 6A, 6B, 6C, 6D, 6E:
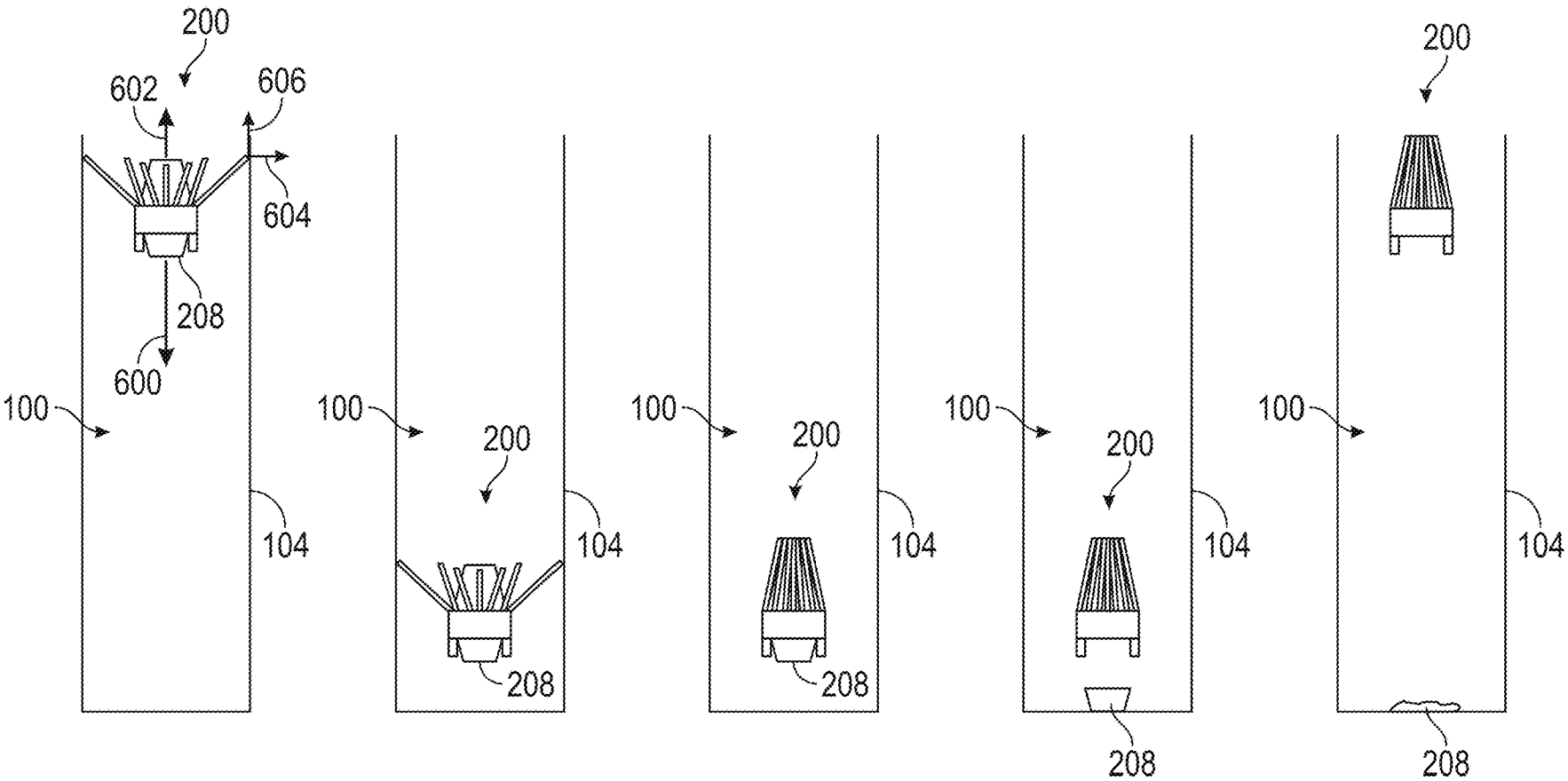
FIGS. 6*a*-6*e* show an operational sequence of the log-down untethered caliper tool (200) in accordance with one or more embodiments.

In FIG. 6*a*, the log-down untethered caliper tool (200) is shown deployed in the conduit (100). The log-down untethered caliper tool (200) is shown in the extended and sinkable position. That is, the fingers (202) are extended away from the axis (214) of the body (204) and the weight (208) is attached to the body (204). Specifically, and because this is the log-down untethered caliper tool (200), the fingers (202) are pointed in a direction from the body (204) towards the buoyancy device (206).

The weight (208) end of the log-down untethered caliper tool (200) enters the conduit (100) followed by the buoyancy device (206) end of the log-down untethered caliper tool (200). In accordance with one or more embodiments, the log-down untethered caliper tool (200) may enter the conduit (100) in the expanded position as shown in FIG. 6*a*. In other embodiments, the log-down untethered caliper tool (200) may enter the conduit (100) in the retracted position in order to avoid damage when the log-down untethered caliper tool (200) enters a wellhead capping the conduit (100) at the surface location (106).

If the log-down untethered caliper tool (200) enters the conduit (100) in the retracted position, the control system (212) may instruct the fingers (202) to extend away from the axis (214) of the body (204) after a certain pressure, temperature, and/or time is sensed/determined by the control system (212). For example, the control system (212) may have an instruction to open the fingers (202) if time is greater than or equal to one minute from the start command, if the sensed pressure is greater than or equal to the shut-in wellhead pressure plus a safety margin. The safety margin may account for pressure fluctuation, pressure sensor calibration, accuracy of the shut-in wellhead pressure, or in cases of 0 psia wellhead pressure.

FIG. 6*a* shows the forces acting on the log-down untethered caliper tool (200). In particular, a gravitational force (600) is exerted on the log-down untethered caliper tool (200). The gravitational force (600) may be influenced by the weight of the log-down untethered caliper tool (200) including the weight (208).

A buoyancy force (602) is also shown acting in an opposing direction to the gravitational force (600). The buoyancy force (602) is influenced by the fluid in the conduit (100) and the operation of the buoyancy device (206). FIG. 6*a* also shows the finger deployment force (604) exerted by the fingers (202) extending outwardly into the wall (104). This force causes a friction force (606) to occur in an opposing direction to the gravitational force (600). Thus, in order for the log-down untethered caliper tool (200) to descend within the conduit (100), the gravitational force (600) must exceed the buoyancy force (602) combined with the friction force (606).

FIG. 6*b* shows the log-down untethered caliper tool (200) descended to a depth within the conduit (100). During the decent, the control system (212) may track the movement of the fingers (202) caused by the wall (104) of the conduit in order to determine the diameter of the conduit (100).

Once at a pre-determined depth, the control system (212) may automatically retract the fingers (202) around the buoyancy device (206), as shown in FIG. 6*c*, and detach the weight (208) from the body (204), as shown in FIG. 6*d*, using the electromagnet (210). The control system (212) may automate these actions in a similar manner to automating the extension of the fingers (202) outlined above.

In accordance with one or more embodiments, the fingers (202) should be retracted prior to detaching the weight (208) because once the weight (208) is detached from the body (204), the buoyancy force (602) is larger than the gravitational force (600) and the log-down untethered caliper tool (200) is able to ascend through the fluid in the conduit (100), as shown in FIG. 6*e*. If the fingers (202) were to be left extended while under the buoyancy force, the fingers (202) may become damaged or stuck in the conduit (100).

Figure 9:
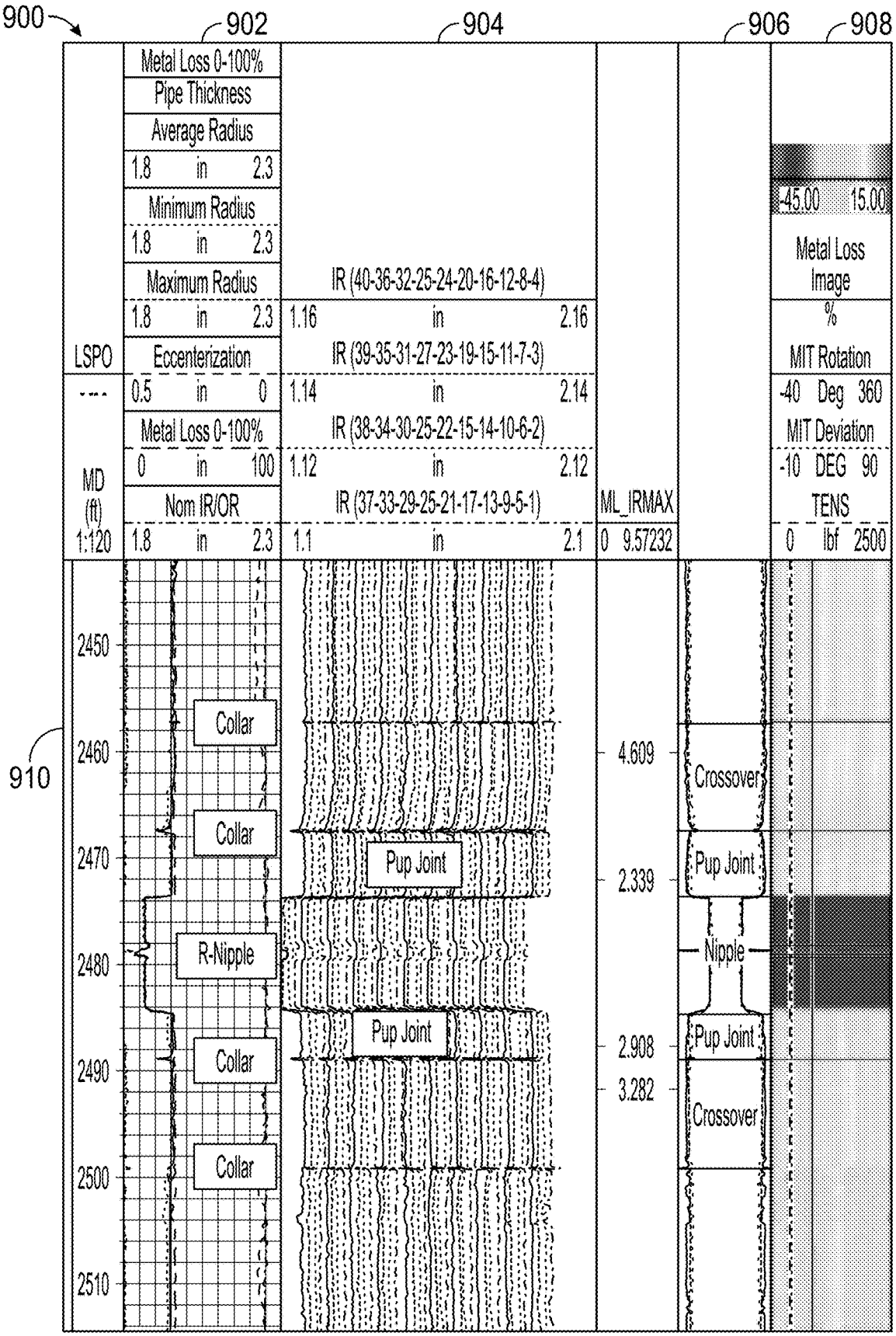
FIG. 9 shows a caliper log in accordance with one or more embodiments.

In further embodiments, the weight (208) may dissolve over time due to the weight (208) being made of a material that can be dissolved by the fluid in the conduit (100). The log-down untethered caliper tool (200) may be sending data constantly to the surface location (106) using the antenna (512), or the data may be downloaded from the log-down untethered caliper tool (200) once the log-down untethered caliper tool (200) has reached the surface location (106). FIG. 9 below shows how the data obtained from the log-down untethered caliper tool (200) may be processed and visualized.

In order to ensure that the log-down untethered caliper tool (200) returns to the surface location (106) in case of an emergency (such as stuck situation, power failure, or sensor failure) a fail-safe mechanism may include the automatic release of the finger deployment force (604) using an electrically or mechanically activated weak-point. In other words, if the log-down untethered caliper tool (200) is stationary for an excessive period defined and programmed in the control system (212), then a command to retract the fingers (202) is sent to close all fingers (202). In case this option is not possible due to power and/or communication failures, the fingers (202) may be linked to the drive mechanism with a weak point that breaks above a certain pull force. In this event, the fingers (202) become lose and/or free.

In any situation, measurement, or intervention that requires the log-down untethered caliper tool (200) to be stationary (such as pressure and temperature readings at regular intervals, readings at the bottom of the well, check-shot seismic surveys . . . etc), the fingers (202) may be used as a mechanical anchoring system to ensure that the log-down untethered caliper tool (200) is stationary and stable at the desired depth.

In other embodiments, the fingers (202) may act as a coupling between the conduit (100) wall (104) and the sensors in the log-down untethered caliper tool (200) (for example, a geophone in the log-down untethered caliper tool (200) may couple to the wall through the tip of the fingers (202) to ensure sonic coupling). In this case, the finger deployment force (604) is controllable and limits (minimum force for logging while moving up and/or down and maximum force for stationary measurements) are set and stored in the control system (212).

FIGS. 7*a*-7*e* show an operational sequence of the log-up untethered caliper tool (300) in accordance with one or more embodiments. Components shown in FIGS. 7*a*-7*e* that are the same as or similar to components shown in FIGS. 1-6*e* have not be re-described for purposes of readability and have the same description and function as outlined above. The operation of the log-up untethered caliper tool (300) is similar to the operation of the log-down untethered caliper tool (200).

Figures 7A, 7B, 7C, 7D, 7E:
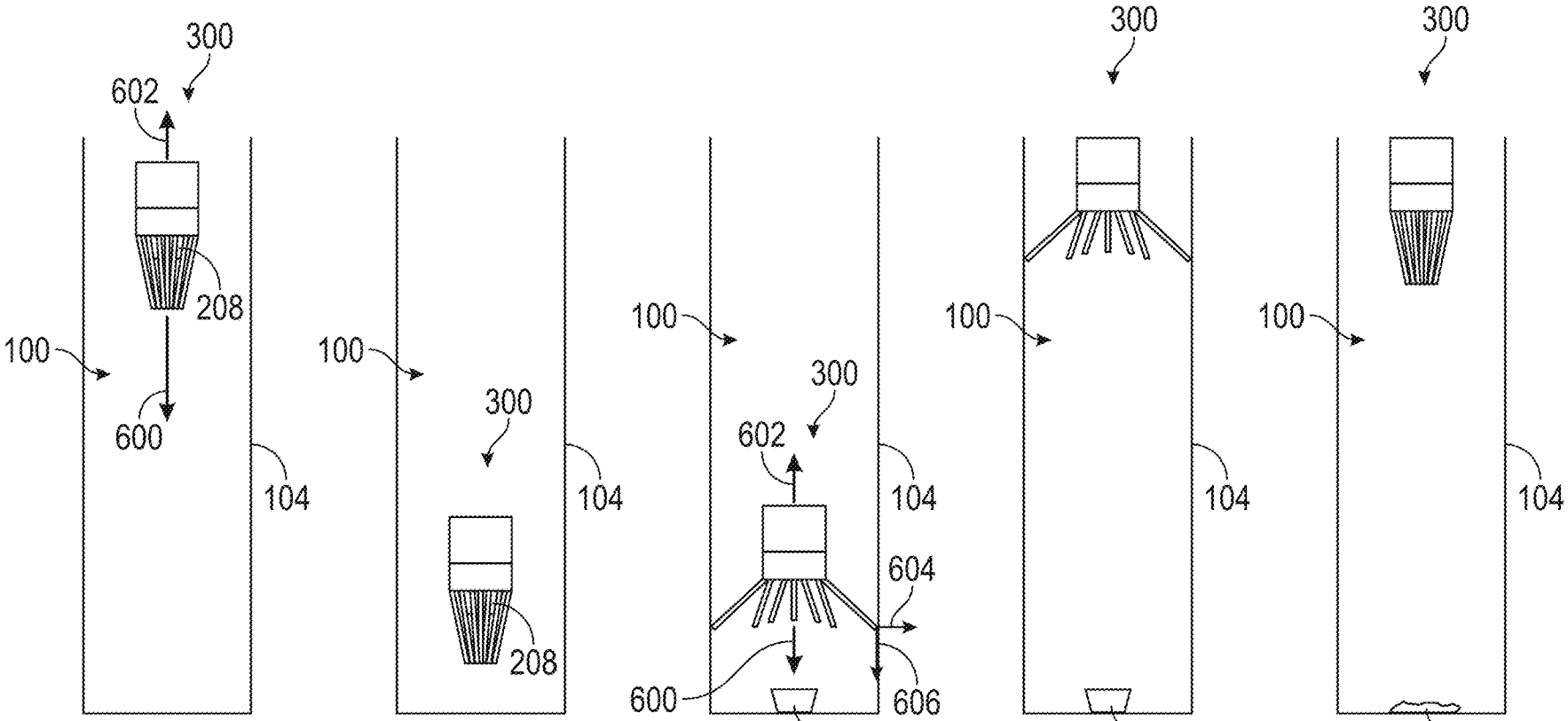
FIGS. 7*a*-7*e* show an operational sequence of the log-up untethered caliper tool (300) in accordance with one or more embodiments.

In FIG. 7*a*, the log-up untethered caliper tool (300) is shown deployed in the conduit (100). The log-up untethered caliper tool (300) is shown in the retracted and sinkable position. That is, the fingers (202) are extended towards the axis (214) of the body (204) and the weight (208) is attached to the body (204). Specifically, and because this is the log-up untethered caliper tool (300), the fingers (202) are pointed in a direction from the body (204) towards the weight (208).

The weight (208) end of the log-up untethered caliper tool (300) enters the conduit (100) followed by the buoyancy device (206) end of the log-down untethered caliper tool (200). FIG. 6*a* shows the forces acting on the log-down untethered caliper tool (200) when in the retracted and sinkable position. Specifically, the gravitational force (600) exerts a downward force on the log-up untethered caliper tool (300) and the buoyancy force (602) exerts an upward force on the log-up untethered caliper tool (300). Thus, in order for the log-up untethered caliper tool (300) to descend within the conduit (100), the gravitational force (600) must exceed the buoyancy force (602).

FIG. 7*b* shows the log-up untethered caliper tool (300) descended to a depth within the conduit (100). During the decent, the control system (212) does not track the movement of the fingers (202) caused by the wall (104) of the conduit (100) but may record other data points such as pressure and temperature.

Once at a pre-determined depth, the control system (212) may automatically extend the fingers (202) from the weight (208), as shown in FIG. 7*c*. The extension of the fingers (202) may cause the weight (208) to detach from the body (204). In other embodiments, the weight (208) may be detached from the body (204) using the electromagnet (210). The control system (212) may automate these actions in a similar manner to automating the extension of the fingers (202) described in FIGS. 6*a*-6*e* above.

Once the weight (208) is detached from the body (204), the log-up untethered caliper tool (300) the buoyancy force (602) is larger than the gravitational force (600) and the log-up untethered caliper tool (300) is able to ascend through the fluid in the conduit (100), as shown in FIGS. 7*c* and 7*d*. FIG. 7*c* shows how the friction force (606) acts on the log-up untethered caliper tool (300), as such, the buoyancy force (602) must be larger than the gravitational force (600) combined with the friction force (606) in order to ascend. During the ascent, the control system (212) may track the movement of the fingers (202) caused by the wall (104) of the conduit in order to determine the diameter of the conduit (100).

Once the log-up untethered caliper tool (300) is at or near the surface location (106), the fingers (202) may retract back around the axis (214) to be removed from the conduit (100) without damaging the fingers (202), as shown in FIG. 7*e*. In further embodiments, the weight (208) may dissolve over time due to the weight (208) being made of a material that can be dissolved by the fluid in the conduit (100).

The log-up untethered caliper tool (300) may be sending data constantly to the surface location (106) using the antenna (512), or the data may be downloaded from the log-up untethered caliper tool (300) once the log-up untethered caliper tool (300) has reached the surface location (106). FIG. 9 below shows how the data obtained from the log-up untethered caliper tool (300) may be processed and visualized.

In order to ensure that the log-up untethered caliper tool (300) returns to the surface location (106) in case of an emergency (such as stuck situation, power failure, or sensor failure) a fail-safe mechanism may include the automatic release of the finger deployment force (604) using an electrically or mechanically activated weak-point. In other words, if the log-up untethered caliper tool (300) is stationary for an excessive period defined and programmed in the control system (212), then a command to retract the fingers (202) is sent to close all fingers (202). In case this option is not possible due to power and/or communication failures, the fingers (202) may be linked to the drive mechanism with a weak point that breaks above a certain pull force. In this event, the fingers (202) become lose and/or free.

In any situation, measurement, or intervention that requires the log-up untethered caliper tool (300) to be stationary (such as pressure and temperature readings at regular intervals, readings at the bottom of the well, check-shot seismic surveys . . . etc), the fingers (202) may be used as a mechanical anchoring system to ensure that the log-up untethered caliper tool (300) is stationary and stable at the desired depth.

In other embodiments, the fingers (202) may act as a coupling between the conduit (100) wall (104) and the sensors in the log-up untethered caliper tool (300) (for example, a geophone in the log-up untethered caliper tool (300) may couple to the wall through the tip of the fingers (202) to ensure sonic coupling). In this case, the finger deployment force (604) is controllable and limits (minimum force for logging while moving up and/or down and maximum force for stationary measurements) are set and stored in the control system (212).

FIGS. 8*a*-8*e* show an operational sequence of the bidirectional untethered caliper tool (400) in accordance with one or more embodiments. Components shown in FIGS. 8*a*-8*e* that are the same as or similar to components shown in FIGS. 1-7*e* have not be re-described for purposes of readability and have the same description and function as outlined above. In accordance with one or more embodiments, the operation of the bidirectional untethered caliper tool (400) combines the operation of the log-down untethered caliper tool (200) and the log-up untethered caliper tool (300).

Figures 8A, 8B, 8C, 8D, 8E:
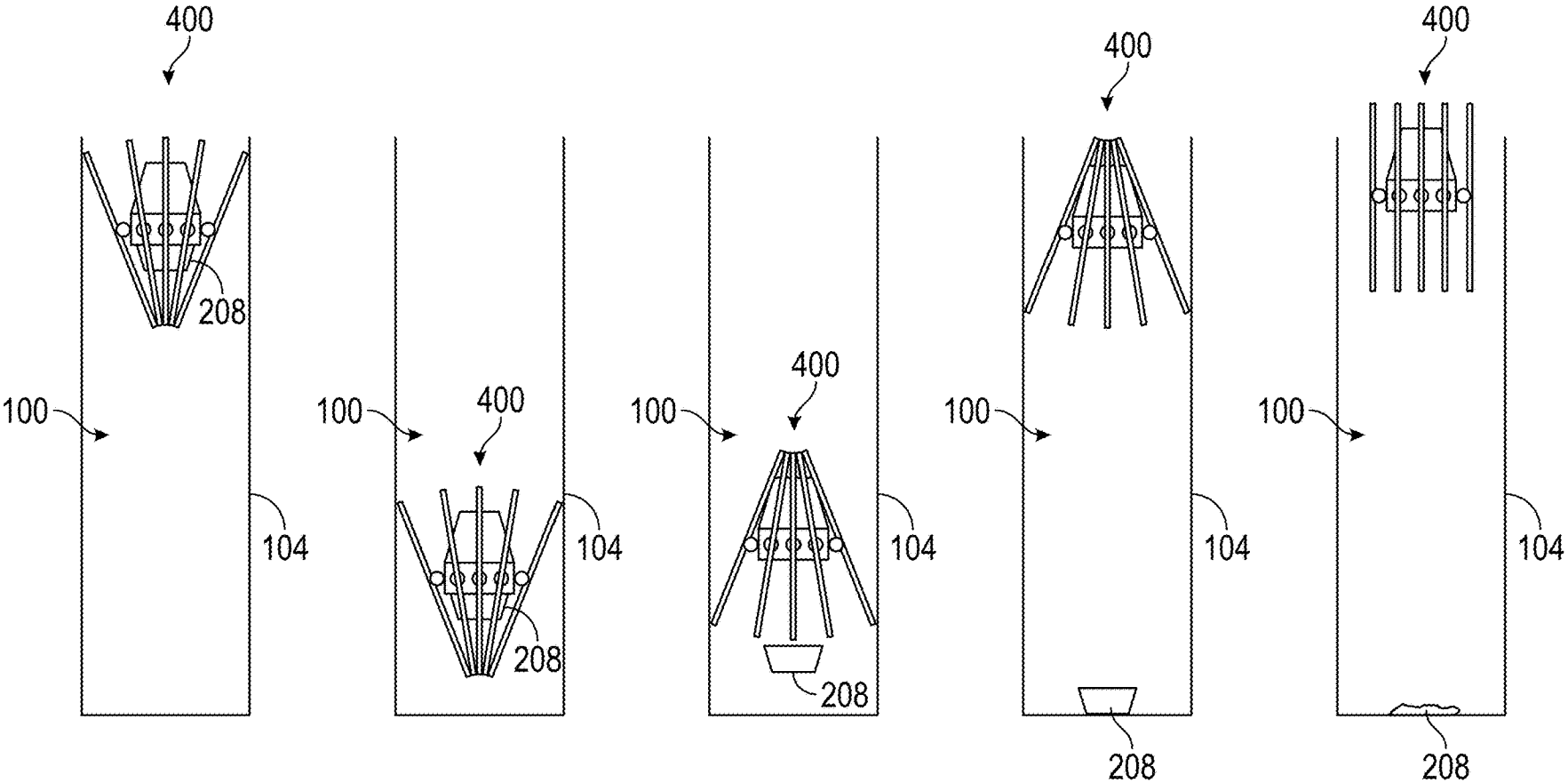
FIGS. 8*a*-8*e* show an operational sequence of the bidirectional untethered caliper tool (400) in accordance with one or more embodiments.

In FIG. 8*a*, the bidirectional untethered caliper tool (400) is shown deployed in the conduit (100). The bidirectional untethered caliper tool (400) is shown in the extended log-down and sinkable position. That is, the fingers (202) are extended around the buoyancy device (206) and the fingers (202) are retracted around the weight (208). In this position, the bidirectional untethered caliper tool (400) may measure the diameter of the conduit (100) as the bidirectional untethered caliper tool (400) descends through the fluid in the conduit (100).

While FIG. 8*a* shows the bidirectional untethered caliper tool (400) deployed in the extended log-down position, the bidirectional untethered caliper tool (400) may be initially deployed in the neutral position to avoid damage to the fingers (202) without departing from the scope of the disclosure herein.

FIG. 8*b* shows the bidirectional untethered caliper tool (400) at a predetermined depth in the conduit (100). At this depth, the bidirectional untethered caliper tool (400) may transition to an extended log-up position. In this transition, the weight (208) may detach from the body (204) due to the extension of the fingers (202) from the weight (208). In other embodiments, the weight (208) may detach from the body (204) due to actuation of the electromagnet (210).

FIG. 8*c* shows the weight (208) detaching from the bidirectional untethered caliper tool (400). Once the weight (208) is detached form the bidirectional untethered caliper tool (400), the bidirectional untethered caliper tool (400) can ascend to the surface location (106). While the bidirectional untethered caliper tool (400) ascends to the surface location (106), the bidirectional untethered caliper tool (400) may measure the diameter of the conduit (100) a second time.

FIG. 8*d* shows the bidirectional untethered caliper tool (400) nearing or at the surface location (106). Once at the surface location (106), the bidirectional untethered caliper tool (400) may move to the neutral position in order to be safely removed from the conduit (100).

The forces acting on the bidirectional untethered caliper tool (400) depend on the position in which it is in. If the bidirectional untethered caliper tool (400) is in the extended log-down position, the forces are the same as those acting on the log-down untethered caliper tool (200). If the bidirectional untethered caliper tool (400) is in the extended log-up position, the forces are the same as those acting on the log-up untethered caliper tool (300).

In further embodiments, the weight (208) may dissolve over time due to the weight (208) being made of a material that can be dissolved by the fluid in the conduit (100). The bidirectional untethered caliper tool (400) may be sending data constantly to the surface location (106) using the antenna (512), or the data may be downloaded from the bidirectional untethered caliper tool (400) once the bidirectional untethered caliper tool (400) has reached the surface location (106). FIG. 9 below shows how the data obtained from the bidirectional untethered caliper tool (400) may be processed and visualized.

In order to ensure that the bidirectional untethered caliper tool (400) returns to the surface location (106) in case of an emergency (such as stuck situation, power failure, or sensor failure) a fail-safe mechanism may include the automatic release of the finger deployment force (604) using an electrically or mechanically activated weak-point. In other words, if the bidirectional untethered caliper tool (400) is stationary for an excessive period defined and programmed in the control system (212), then a command to retract the fingers (202) is sent to close all fingers (202). In case this option is not possible due to power and/or communication failures, the fingers (202) may be linked to the drive mechanism with a weak point that breaks above a certain pull force. In this event, the fingers (202) become lose and/or free.

In any situation, measurement, or intervention that requires the bidirectional untethered caliper tool (400) to be stationary (such as pressure and temperature readings at regular intervals, readings at the bottom of the well, checkshot seismic surveys . . . etc), the fingers (202) may be used as a mechanical anchoring system to ensure that the bidirectional untethered caliper tool (400) is stationary and stable at the desired depth.

In other embodiments, the fingers (202) may act as a coupling between the conduit (100) wall (104) and the sensors in the bidirectional untethered caliper tool (400) (for example, a geophone in the bidirectional untethered caliper tool (400) may couple to the wall through the tip of the fingers (202) to ensure sonic coupling). In this case, the finger deployment force (604) is controllable and limits (minimum force for logging while moving up and/or down and maximum force for stationary measurements) are set and stored in the control system (212).

FIG. 9 shows a caliper log (900) in accordance with one or more embodiments. The caliper log (900) is an example of the data that is obtained from the untethered caliper tool (200, 300, 400). The caliper log (900) may be created by programs located in the control system (212). In other embodiments, the data gathered by the control system (212) may be uploaded to a computer having the ability to create the caliper log (900) from the data. Once data is retrieved, conversion of time driven logs to depth (910) can be done using other techniques in prior arts or using collar detection from the fingers (202).

Column A (902) in the caliper log (900) shows the collar locations based on the data from the fingers (202). Column B (904) shows the inner radius of the conduit (100) at each depth (910) using the fingers (202). Column C (906) translates the radii into a visual diameter of the conduit (100) at each depth (910). Column D (908) shows the metal loss at each depth (910). The metal loss may be based on the difference between the theoretical conduit (100) diameter and the measured conduit (100) diameter.

Figure 10:
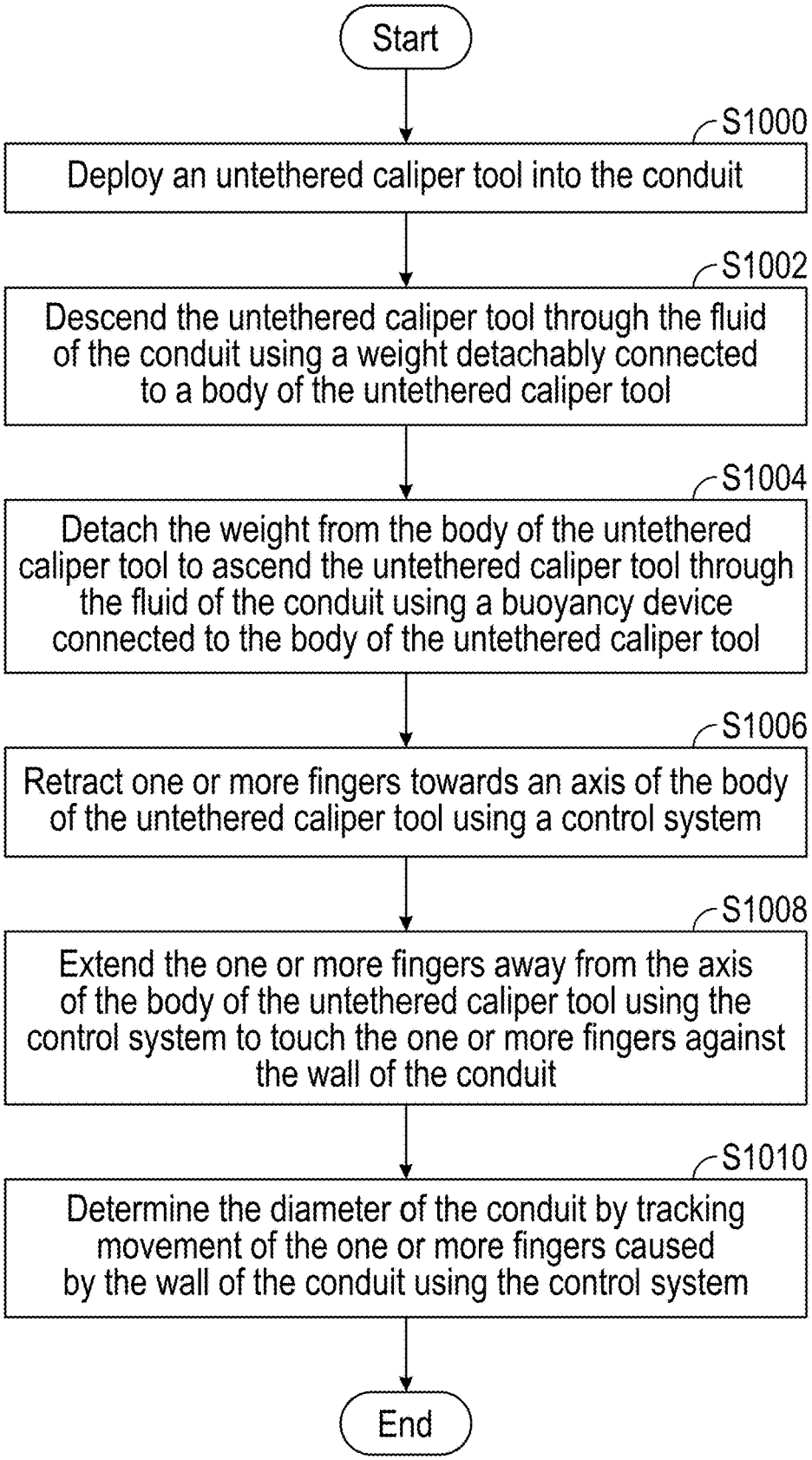
FIG. 10 shows a flowchart in accordance with one or more embodiments.

FIG. 10 shows a flowchart in accordance with one or more embodiments. The flowchart outlines a method for measuring a diameter of a conduit (100) having a wall (104) and a fluid. While the various blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S1000, an untethered caliper tool is deployed into the conduit (100). Prior to deployment of the untethered caliper tool, the untethered caliper tool may be designed to the specific conduit (100) and fluid by selection of finger (202) length, finger (202) number, body (204) size, buoyance device, weight (208), etc. The untethered caliper tool may also be calibrated as outlined above prior to deployment in the conduit (100).

In accordance with one or more embodiments the untethered caliper tool may be the log-down untethered caliper tool (200) outlined in FIGS. 2*a*-2*c* and whose operational sequence is outlined in FIGS. 6*a*-6*e*. In other embodiments, the untethered caliper tool may be the log-up untethered caliper tool (300) outlined in FIGS. 3*a* and 3*b* and whose operational sequence is outlined in FIGS. 7*a*-7*e*. In further embodiments, the untethered caliper tool may be the bidirectional untethered caliper tool (400) outlined in FIGS. 4*a*-4*c* and whose operational sequence is outlined in FIGS. 8*a*-8*e*.

In S1002, the untethered caliper tool (200, 300, 400) is descended through the fluid in the conduit (100) using a weight (208) detachably connected to a body (204) of the untethered caliper tool (200, 300, 400). In accordance with one or more embodiments, the weight (208) allows the gravitational force (600) of the untethered caliper tool (200, 300, 400) to exceed a buoyancy force (602) created fluid acting on the untethered caliper tool (200, 300, 400).

In S1004, the weight (208) is detached from the body (204) of the untethered caliper tool (200, 300, 400) to ascend the untethered caliper tool (200, 300, 400) through the fluid of the conduit (100) using a buoyancy device (206) connected to the body (204) of the untethered caliper tool (200, 300, 400). In accordance with one or more embodiments, the buoyancy device (206) allows the buoyancy force (602) to exceed the gravitational force (600) acting on the untethered caliper tool (200, 300, 400) without the weight (208).

In accordance with one or more embodiments, the weight (208) may be detached from the body (204) by actuating an electromagnet (210) using a control system (212) located in the untethered caliper tool (200, 300, 400). In other embodiments, the weight (208) may be detached from the body (204) by extending the fingers (202) of the untethered caliper tool (200, 300, 400) away from the weight (208).

In S1006, one or more fingers (202) are retracted towards an axis (214) of the body (204) of the untethered caliper tool (200, 300, 400). In the log-down untethered caliper tool (200), the fingers (202) may be retracted around the buoyancy device (206) to enter and leave the conduit (100) and when ascending through the conduit (100). In the log-up untethered caliper tool (300), the fingers (202) may be retracted around the weight (208) to enter and leave the conduit (100) and when descending through the conduit (100).

In the bidirectional untethered caliper tool (400), the fingers (202) may be retracted around both the weight (208) and the buoyancy device (206) depending on if the bidirectional untethered caliper tool (400) is ascending or descending. In the bidirectional untethered caliper tool (400), the fingers (202) may be in the neutral position when entering and leaving the conduit (100).

In S1008, the one or more fingers (202) are extended away from the axis (214) of the body (204) of the untethered caliper tool (200, 300, 400) using the control system (212) to touch the one or more fingers against the wall (104) of the conduit (100). In the log-down untethered caliper tool (200), the fingers (202) may be extended when descending through the conduit (100). In the log-up untethered caliper tool (300), the fingers (202) may be extended when ascending through the conduit (100).

In the bidirectional untethered caliper tool (400), the fingers (202) are extended and retracted at the same time. The difference between positions of the bidirectional untethered caliper tool (400) is if the fingers (202) are retracted around the weight (208) or the buoyancy device (206). As such, for the bidirectional untethered caliper tool (400), the fingers (202) may be retracted around the weight (208) and extended from the buoyancy device (206) when descending through the conduit (100). In other embodiments, the fingers (202) are retracted around the buoyancy device (206) and extended away from the end of the bidirectional untethered caliper tool (400) where the weight (208) connects to when ascending through the conduit (100).

In S1006, the diameter of the conduit (100) is determined by tracking movement of the one or more fingers (202) caused by the wall (104) of the conduit (100) using the control system (212). In the log-down untethered caliper tool (200), the diameter may be calculated while descending through the conduit (100). In the log-up untethered caliper tool (300), the diameter may be calculated while ascending through the conduit (100). In the bidirectional untethered caliper tool (400), the diameter may be calculated while both ascending and descending through the conduit (100).

In further embodiments, the control system (212) has automation capabilities and may automate the above methodology using a program stored on the control system (212) that uses sensors and/or a timer to instruct the untethered caliper tool (200, 300, 400) to perform the various functions. For example, the control system (212) may automatically detach the weight (208) from the body (204) of the untethered caliper tool (200, 300, 400), retract the fingers (202) towards the axis (214) of the body (204) of the untethered caliper tool (200, 300, 400), and extend the fingers (202) away from the axis (214) of the body (204) of the untethered caliper tool (200, 300, 400) using a program stored in the control system (212) that uses temperature and pressure data gathered by a pressure sensor (516), a temperature sensor (518), and/or a timer to track a location of the untethered caliper tool (200, 300, 400) in the conduit (100). The control system (212) may use the location in the conduit to determine which action to perform.

In accordance with one or more embodiment, the control system (212) stores energy using a battery printed circuit board (500), distributes energy throughout the control system (212) from the battery printed circuit board (500) using a power printed circuit board (502), sends instructions throughout the control system (212) using a control printed circuit board (504), and transmits data and instructions between the control printed circuit board (504) and the remainder of the untethered caliper tool (200, 300, 400) using a chassis printed circuit board (506).

The data gathered by the control system (212) may be stored in the memory of the control system (212) to be uploaded to a computer when the untethered caliper tool (200, 300, 400) is at the surface location (106). In other embodiments, the data gathered by the control system (212) may be transmitted to a computer at the surface location (106) using an antenna (512) in the control system (212).

The data gathered by the untethered caliper tool (200, 300, 400) may immediately represent the diameter of the conduit (100) due to a series of programs in the control system (212), or the data gathered by the untethered caliper tool (200, 300, 400) may require further processing to translate from radii readings to diameter readings without departing from the scope of the disclosure herein. The data may represent itself in a caliper log, such as the caliper log (900) shown in FIG. 9.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An untethered caliper tool for measuring a diameter of a conduit having a wall and a fluid, the untethered caliper tool comprising:

one or more fingers connected to a body and configured to extend or retract about an axis of the body;

a control system located within the body, having automation capabilities, configured to track movement of the one or more fingers caused by the wall of the conduit, and configured to determine the diameter of the conduit based on the movement of the one or more fingers;

a buoyancy device connected to the body; and a weight detachably connected to the body, wherein the weight is configured to allow the body to descend through the fluid in the conduit and the buoyancy device is configured to allow the body to ascend through the fluid in the conduit when the weight is removed from the body.

2. The untethered caliper tool of claim 1, wherein the one or more fingers are configured to retract around the buoyancy device.

3. The untethered caliper tool of claim 1, wherein the one or more fingers are configured to retract around the weight.

4. The untethered caliper tool of claim 1, wherein the one or more fingers are configured to retract around both the buoyancy device and the weight.

5. The untethered caliper tool of claim 1, wherein the weight is detachably connected to the body through an electromagnet controllable by the control system.

6. The untethered caliper tool of claim 1, wherein the weight is detachably connected to the body by being cradled against the body using the one or more fingers in a retracted position.

7. The untethered caliper tool of claim 1, wherein the control system comprises a caliper sensor configured to track the movement of the one or more fingers.

8. The untethered caliper tool of claim 1, wherein the control system comprises a pressure sensor and a temperature sensor.

9. The untethered caliper tool of claim 8, wherein the control system is configured to use data gathered by the pressure sensor and the temperature sensor to extend or retract the one or more fingers and detach the weight from the body.

10. The untethered caliper tool of claim 1, wherein the control system comprises:

a battery printed circuit board configured to store energy;

a power printed circuit board configured to distribute the energy from the battery printed circuit board through the control system;

a control printed circuit board configured to send instructions throughout the control system; and a chassis printed circuit board configured to provide electrical and mechanical connection between components within the control system.

11. A method for measuring a diameter of a conduit having a wall and a fluid, the method comprising:

deploying an untethered caliper tool into the conduit;

descending the untethered caliper tool through the fluid of the conduit using a weight detachably connected to a body of the untethered caliper tool;

detaching the weight from the body of the untethered caliper tool to ascend the untethered caliper tool through the fluid of the conduit using a buoyancy device connected to the body of the untethered caliper tool;

retracting one or more fingers towards an axis of the body of the untethered caliper tool using a control system;

extending the one or more fingers away from the axis of the body of the untethered caliper tool using the control system to touch the one or more fingers against the wall of the conduit; and determining the diameter of the conduit by tracking movement of the one or more fingers caused by the wall of the conduit using the control system.

12. The method of claim 11, wherein retracting the one or more fingers towards the axis of the body of the untethered caliper tool further comprises retracting the one or more fingers around the buoyancy device.

13. The method of claim 11, wherein retracting the one or more fingers towards the axis of the body of the untethered caliper tool further comprises retracting the one or more fingers around the weight.

14. The method of claim 11, wherein retracting the one or more fingers towards the axis of the body of the untethered caliper tool further comprises retracting the one or more fingers around both the buoyancy device and the weight.

15. The method of claim 11, wherein detaching the weight from the body of the untethered caliper tool further comprises actuating an electromagnet using the control system.

16. The method of claim 11, wherein detaching the weight from the body of the untethered caliper tool further comprises extending the one or more fingers away from the weight.

17. The method of claim 11, wherein tracking the movement of the one or more fingers caused by the wall of the conduit further comprises using a caliper sensor connected to the control system.

18. The method of claim 11, wherein detaching the weight from the body of the untethered caliper tool, retracting the one or more fingers towards the axis of the body of the untethered caliper tool, and extending the one or more fingers away from the axis of the body of the untethered caliper tool are automated using the control system.

19. The method of claim 18, wherein detaching the weight from the body of the untethered caliper tool, retracting the one or more fingers towards the axis of the body of the untethered caliper tool, and extending the one or more fingers away from the axis of the body of the untethered caliper tool are automated using a program stored in the control system that uses temperature and pressure data gathered by a pressure sensor and a temperature sensor to track a location of the untethered caliper tool in the conduit.

20. The method of claim 11, wherein the control system stores energy using a battery printed circuit board, distributes energy throughout the control system from the battery printed circuit board using a power printed circuit board, and sends instructions throughout the control system using a control printed circuit board.

* * * * *